US007536788B2

(12) United States Patent
VanHoy et al.

(10) Patent No.: US 7,536,788 B2
(45) Date of Patent: May 26, 2009

(54) FOLDING KNIFE

(75) Inventors: Edward Tate VanHoy, Abindgon, VA (US); Tanya Dion VanHoy, Abingdon, VA (US); Tong Chiu, Taichung Hsien (TW)

(73) Assignee: GB II Corporation, Tualatin, OR (US)

( * ) Notice: Subject to any disclaimer, the term of this patent is extended or adjusted under 35 U.S.C. 154(b) by 178 days.

(21) Appl. No.: 11/051,184

(22) Filed: Feb. 3, 2005

(65) Prior Publication Data

US 2005/0223563 A1 Oct. 13, 2005

Related U.S. Application Data

(60) Provisional application No. 60/561,483, filed on Apr. 12, 2004.

(51) Int. Cl.
*B26B 1/04* (2006.01)

(52) U.S. Cl. ..... 30/154; 30/160; 30/161; 30/155

(58) Field of Classification Search ..... 30/151–163, 30/143, 112, 142–150; D8/98–99; 132/76.2; 81/3.35; 7/118–120, 168
See application file for complete search history.

(56) References Cited

U.S. PATENT DOCUMENTS

| | | | | | |
|---|---|---|---|---|---|
| 220,438 | A | | 10/1879 | Slayton | |
| 338,853 | A | | 3/1886 | Marks | |
| 535,845 | A | * | 3/1895 | Melchior | 30/154 |
| 588,174 | A | | 8/1897 | Praunegger | |
| 825,212 | A | | 7/1906 | Henkel | |
| 2,183,901 | A | | 12/1939 | Weaver | |
| 2,286,524 | A | | 6/1942 | Wilbur | |
| 3,176,395 | A | * | 4/1965 | Warner et al. | 30/154 |
| 4,148,140 | A | * | 4/1979 | Lile | 30/161 |
| 4,240,201 | A | | 12/1980 | Sawby et al. | |
| 4,404,748 | A | * | 9/1983 | Wiethoff | 30/161 |
| 4,502,221 | A | * | 3/1985 | Pittman | 30/160 |
| 4,536,959 | A | * | 8/1985 | Ross | 30/161 |
| 4,604,803 | A | | 8/1986 | Sawby | |
| 4,670,984 | A | * | 6/1987 | Rickard | 30/161 |
| 4,893,409 | A | * | 1/1990 | Poehlmann | 30/161 |
| 4,918,820 | A | * | 4/1990 | Korb et al. | 30/161 |
| 5,029,354 | A | * | 7/1991 | Boyd et al. | 7/118 |
| 5,060,379 | A | | 10/1991 | Neely | |
| 5,072,513 | A | * | 12/1991 | Matsushima | 30/161 |
| 5,111,581 | A | * | 5/1992 | Collins | 30/161 |
| 5,442,855 | A | * | 8/1995 | Jobin | 30/161 |
| 5,495,674 | A | * | 3/1996 | Taylor, Jr. | 30/160 |

(Continued)

*Primary Examiner*—Boyer D. Ashley
*Assistant Examiner*—Laura M. Lee
(74) *Attorney, Agent, or Firm*—Klarquist Sparkman, LLP

(57) ABSTRACT

A folding knife includes a handle portion and a blade pivotally coupled to the handle portion for pivoting movement between an open position and a closed position. The knife can include a locking mechanism that retains the blade against pivoting movement when it is in the open position. In particular embodiments, the blade is coupled to the handle portion such that the application of pressure to the blade in a predetermined direction causes displacement of blade relative to the handle portion in the plane within which the blade pivots. The displacement of the blade relative to the handle portion is effective to release the blade from the locking mechanism and allow the blade to be pivoted to the closed position.

19 Claims, 10 Drawing Sheets

U.S. PATENT DOCUMENTS

| | | | | | |
|---|---|---|---|---|---|
| 5,502,895 | A | | 4/1996 | Lemaire | |
| 5,661,908 | A | * | 9/1997 | Chen | 30/125 |
| 5,815,927 | A | * | 10/1998 | Collins | 30/161 |
| 5,822,866 | A | * | 10/1998 | Pardue | 30/161 |
| 5,915,792 | A | * | 6/1999 | Sakurai | 30/161 |
| 6,145,202 | A | | 11/2000 | Onion | |
| 6,305,085 | B1 | * | 10/2001 | Stallegger et al. | 30/161 |
| 6,826,836 | B1 | * | 12/2004 | Lin | 30/161 |
| 7,080,457 | B2 | * | 7/2006 | Sullivan | 30/160 |
| 7,093,367 | B1 | * | 8/2006 | Huang | 30/519 |
| 2003/0213134 | A1 | * | 11/2003 | Sakai | 30/161 |

* cited by examiner

FOLDING KNIFE

CROSS-REFERENCE TO RELATED APPLICATION

The present application claims the benefit of U.S. Provisional Application No. 60/561,483, filed Apr. 12, 2004, which is incorporated herein by reference.

FIELD

The present disclosure relates generally to embodiments of a folding knife.

BACKGROUND

Most folding knives utilize a partially moveable spline along the center of the handle to bias a blade to an open or closed position by sliding contact against the tang of the blade. In addition, folding knives typically include a locking mechanism to lock the blade against pivoting movement when the blade is in the open position. Such locking mechanisms typically are complex and add substantially to the cost of the knife. Further, most folding knives can be difficult to operate for persons that have limited use of both hands.

Accordingly, there remains much room for improvement in the prior art.

SUMMARY

The present disclosure concerns embodiments of a folding knife having a handle portion and a blade that is pivotally coupled to the handle portion. The blade can be pivoted relative to the handle portion between an open position and a closed position. The knife can include a locking mechanism that retains the blade against pivoting movement when it is in the open position. The locking mechanism can be, for example, a locking pin mounted to the handle portion and positioned to engage a locking slot in the tang portion of the blade.

In particular embodiments, the blade is coupled to the handle portion such that the application of pressure to the top of the blade causes displacement of blade relative to the handle portion in the plane within which the blade pivots. The displacement of the blade relative to the handle portion is effective to release the blade from the locking mechanism and allow the blade to be pivoted to the closed position. The knife also can include at least one biasing mechanism, such as a coil spring, operatively coupled to the blade and the knife. The biasing mechanism provides a biasing force that resiliently urges the blade to engage the locking mechanism when the blade is in the open position.

In certain embodiments, the handle portion includes an elongated slot in which there is disposed a pivot pin for pivotally supporting the blade and at least one spring that bears against the pivot pin. When the blade is in the open position, the spring urges the pivot pin in a first direction to cause the blade to engage the locking member. When manual pressure is applied to the blade in a second direction, opposite the first direction, the blade can be displaced against the force of the spring and relative to the handle portion to release the blade from the locking member.

To assist a user in opening and/or closing the knife, at least one wheel can be coupled to the tang portion of the blade. Closing and/or opening the knife can be easily accomplished using only one hand. For example, when the blade is in the open position, a user grasps the knife in a normal manner and applies sufficient pressure to the wheel with the thumb so as to cause the blade to shift relative to the handle portion and release from its engagement with the locking member. The wheel can then be rotated with the thumb so as to cause the blade to pivot to the closed position. To open the knife, the wheel can be rotated in the opposite direction with the thumb so as to cause the blade to pivot to the open position.

The knife also can include a second locking member that prevents inadvertent displacement of the blade when it is in the open position. The second locking member can be, for example, a locking lever that is moveable between a first, locked position and a second, unlocked position. When the locking lever is in the locked position, the locking lever engages the pivot pin and therefore prevents displacement of the pin and the blade relative to the handle portion. When the locking lever is in the unlocked position, the locking lever is removed from engagement with the pivot pin to allow displacement of the blade relative to the handle portion.

In another embodiment, the pivot pin is secured at a fixed position relative to the handle portion and the blade includes an elongated slot that receives the pivot pin. At least one coil spring or other biasing mechanism in disposed in the slot and provides a biasing force that causes the blade to engage the locking member when the blade is in the open position. Manual pressure applied to the blade in a predetermined direction causes the blade to shift relative to the pivot pin and the handle portion. Displacement of the blade causes the blade to be released from its engagement with the locking member so that the blade can be pivoted to the closed position.

The foregoing and other features and advantages of the invention will become more apparent from the following detailed description of several embodiments, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises."

Figure 7:
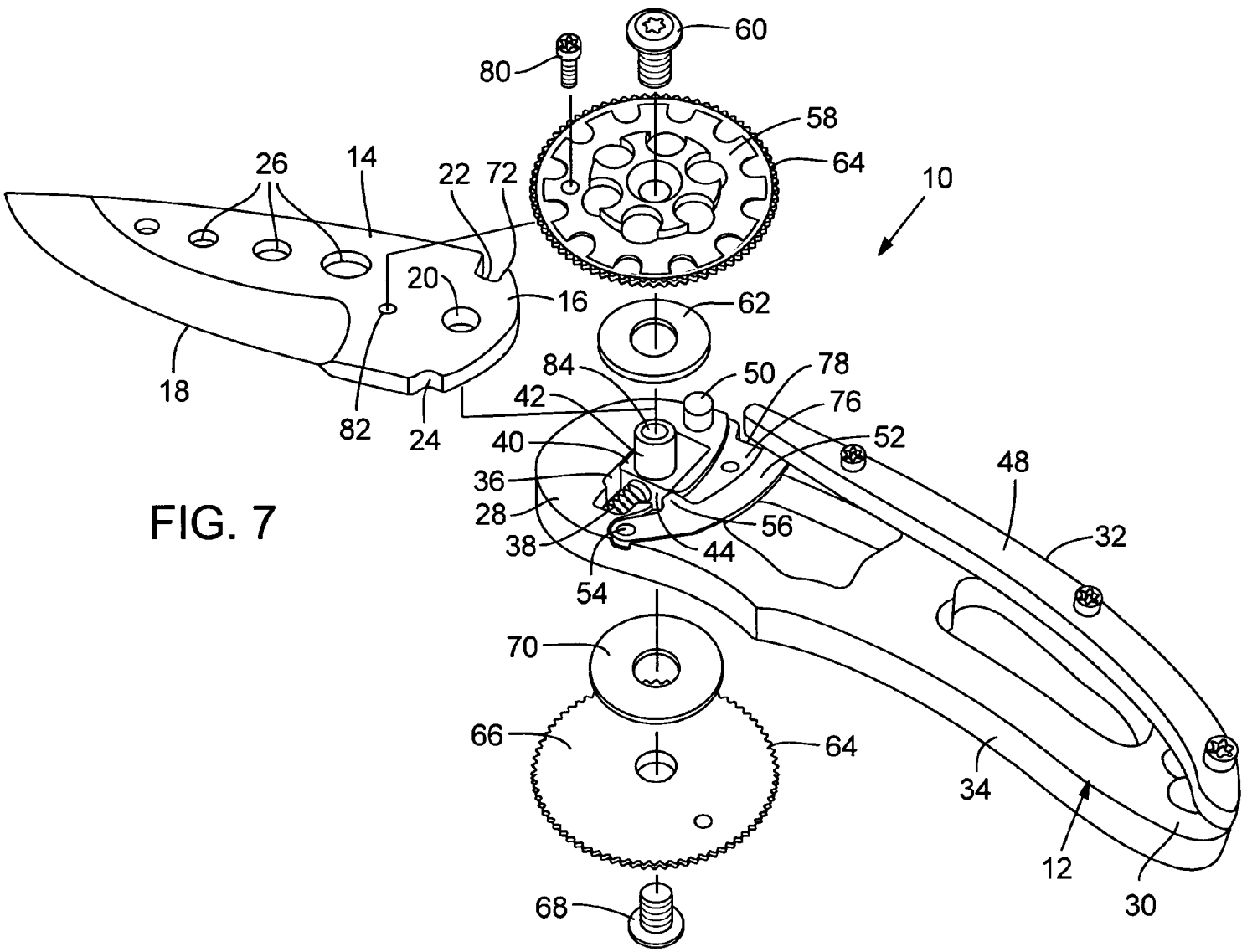
FIG. 7 is a perspective, exploded view of the knife of FIG. 1.

FIGS. 1-9 show a folding knife 10, according to one embodiment. The knife 10 generally includes a handle portion, or frame, 12 and a blade 14 that is pivotally coupled to the handle portion 12 for pivoting movement between an open position (FIGS. 1, 2, 8 and 9) and a closed position (FIGS. 3-6 and 10). As best shown in FIG. 7, the blade 14 has a tang portion 16 at its inner end and a conventional sharpened lower edge 18. The illustrated blade 14 also includes an opening 20, a locking slot 22, and a detent 24 formed in the tang portion 16. The blade 14 can have any of various shapes or configurations. For example, the blade 14 can have a series of spaced-apart openings 26 along its length to reduce the overall weight of the knife.

Figure 8:
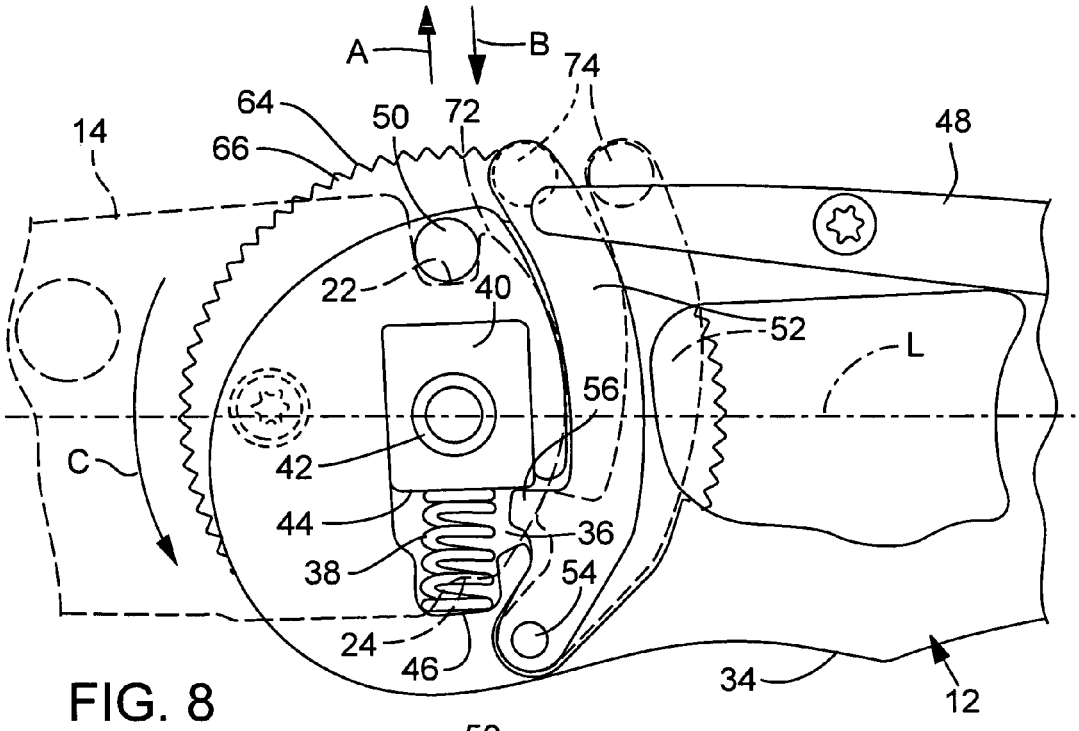
FIG. 8 is an enlarged, partial side elevation view of the knife of FIG. 1, showing a locking pin engaging a locking slot in the tang portion of the blade to prevent pivoting of the blade.
Figure 9:
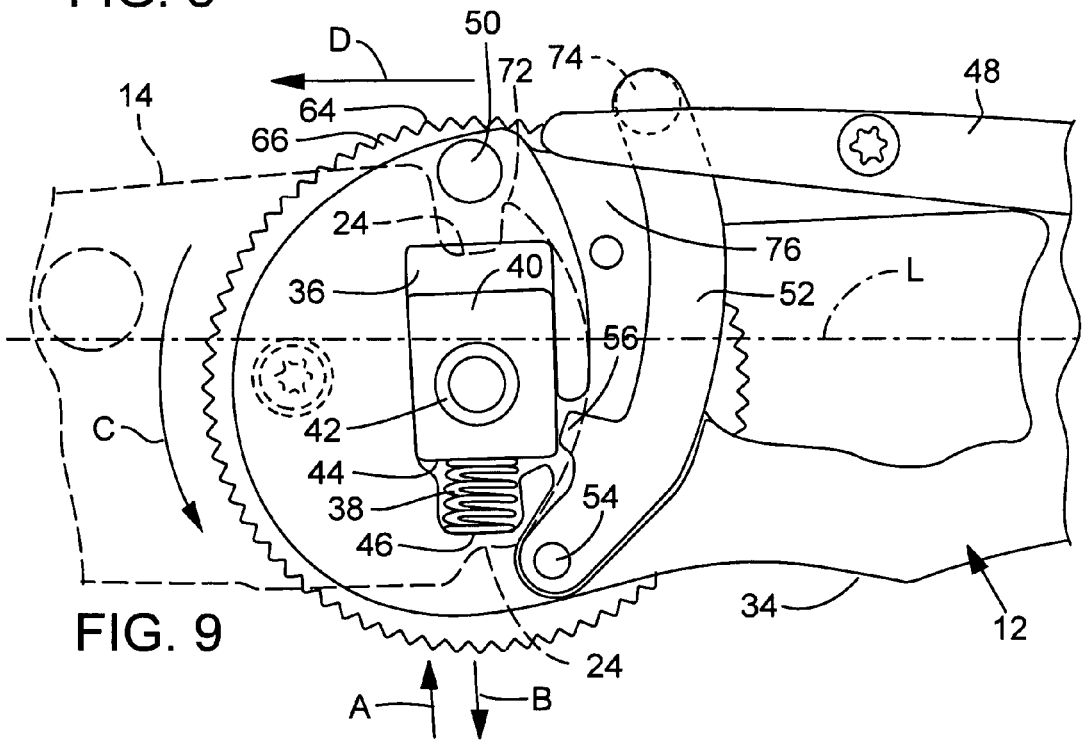
FIG. 9 is an enlarged, partial side elevation view similar to FIG. 8, but showing the blade released from the locking pin.

The handle portion 12 has a distal end portion 28 coupled to the tang portion 16, a proximal end portion 30, an upper surface 32, and a lower surface 34. The handle portion 12 defines a longitudinal axis L (FIGS. 8 and 9) extending between the distal end portion 28 and the proximal end portion 30. As best shown in FIGS. 7-9, the distal end portion 28 in the illustrated embodiment is formed with an elongated slot 36 that contains at least one biasing member, such as the illustrated compression spring 38, and the base 40 of a pivot pin 42. The pivot pin 42 extends transversely from the base 40 into the opening 20 of the tang portion 16 for pivotally supporting the blade 14 relative to the handle portion 12.

The slot 36 in the illustrated configuration is dimensioned to permit limited displacement of the base 40 in the slot along an axis that is generally perpendicular to the longitudinal axis L of the handle portion 12, as indicated by arrows A and B in FIGS. 8 and 9. This allows for corresponding displacement of the blade 14 in the same directions in the plane within which the blade 14 pivots. The spring 38 extends between a lower surface 44 of the base 40 and an opposing surface 46 (FIGS. 8 and 9) of the slot 36 so as to resiliently urge the base 40, and therefore the blade 14, in a direction toward the upper surface 32 of the handle portion 12 (in the direction indicated by arrow A). The handle portion 12 also can include a blade guard 48 mounted adjacent the upper surface 32 of the handle portion 12 to cover the sharpened edge 18 of the blade 14 when the blade is in the closed (folded) position.

Figure 10:
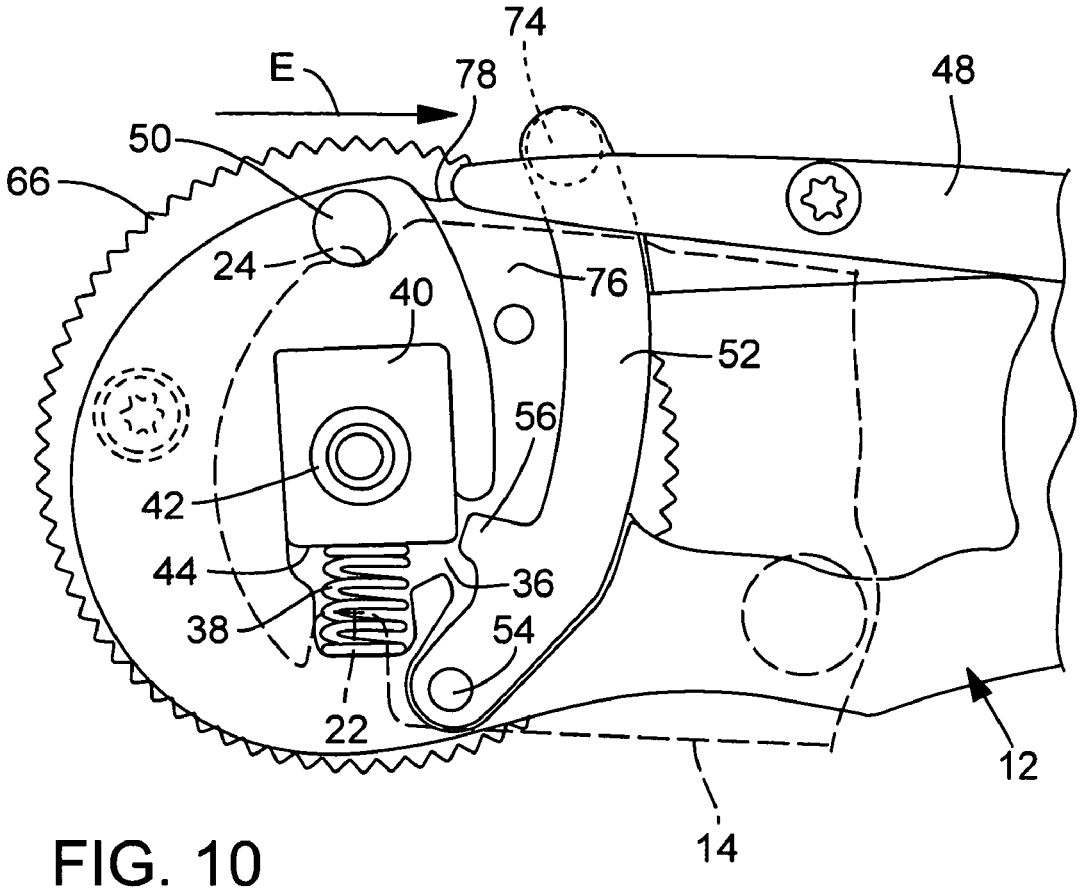
FIG. 10 is an enlarged, partial side elevation view similar to FIG. 8, but showing the blade in the closed position.

The knife 10 desirably includes a locking member to prevent pivoting movement of the blade 14 when it is in the open position. For example, in the illustrated embodiment, a locking pin 50 extends transversely from a side surface of the distal end portion 28 of the handle portion 12 (as best shown in FIG. 7). As shown in FIG. 8, the locking pin 50 is positioned to engage the locking slot 22 of the blade 14 and prevent pivoting movement of the blade when it is in the open position. The blade 14 is releasable from engagement with the locking pin 50 in response to displacement of the blade relative to the handle portion 12 in the direction of arrow B, as further described below. As shown in FIG. 10, the locking pin 50 also engages the detent 24 in the tang portion 16 when the blade is pivoted to the closed position.

Figure 1:
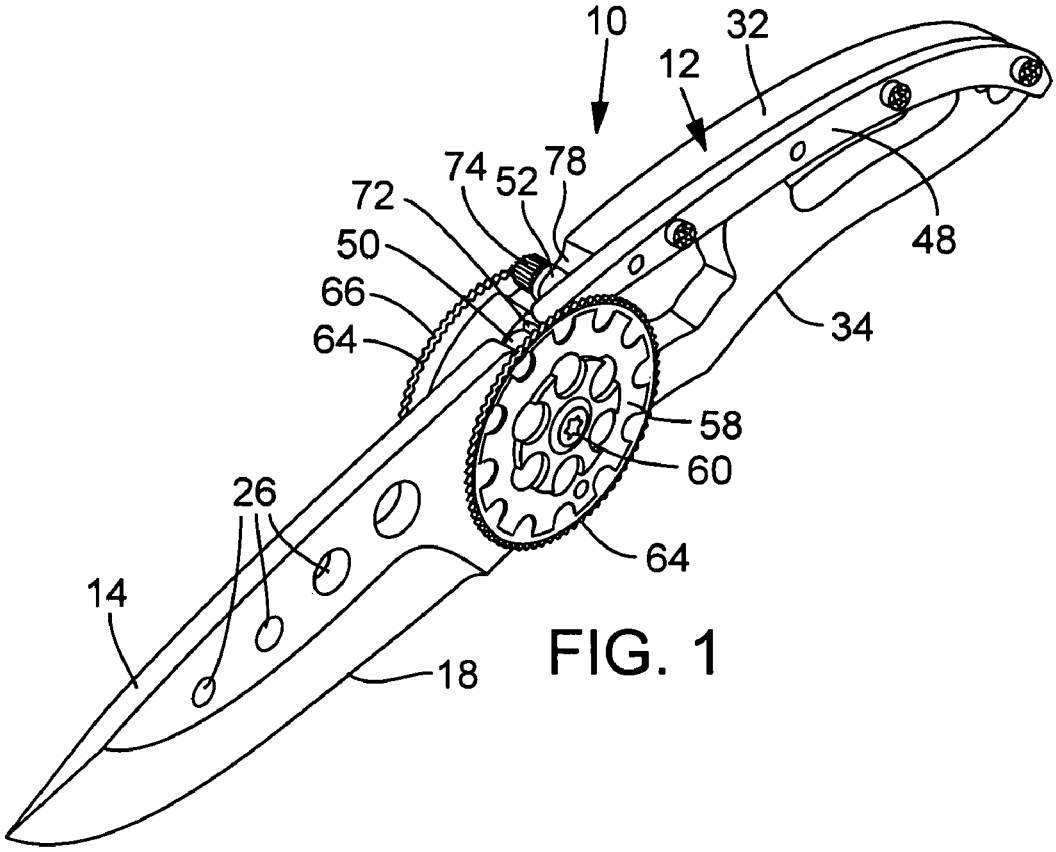
FIG. 1 is a perspective view of a folding knife showing the blade in an open position for use, as viewed from the top and one side of the knife, according to one embodiment.
Figure 2:
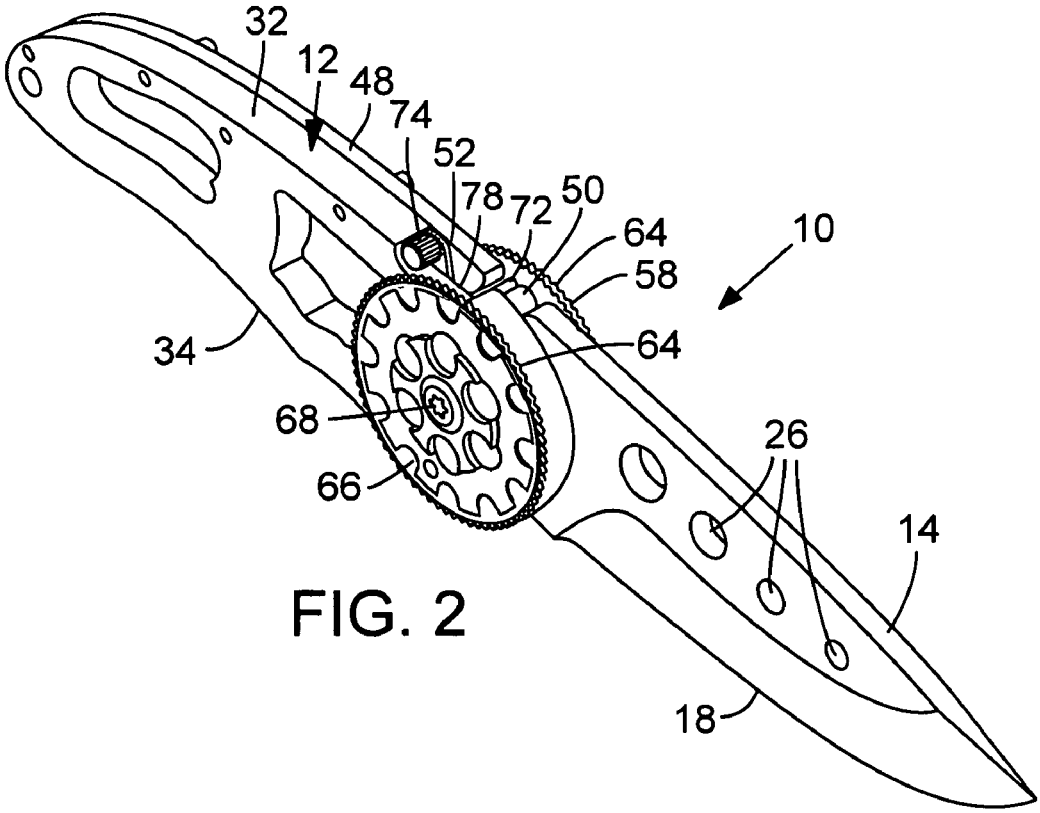
FIG. 2 is a perspective view of the folding knife shown in FIG. 1, as viewed from the top and the opposite side of the knife.
Figure 3:
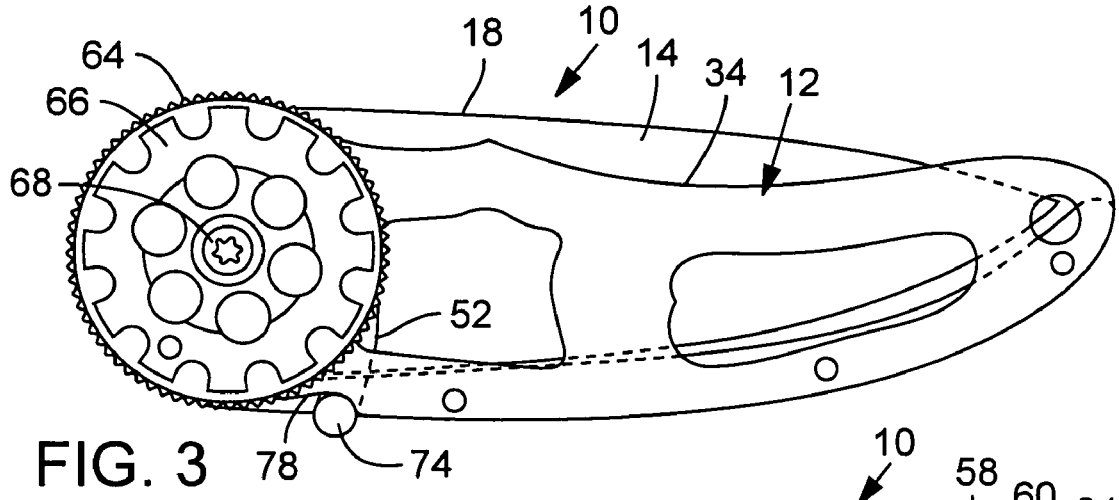
FIG. 3 is a side elevation view of the knife of FIG. 1 showing the blade in a closed position.
Figure 4:
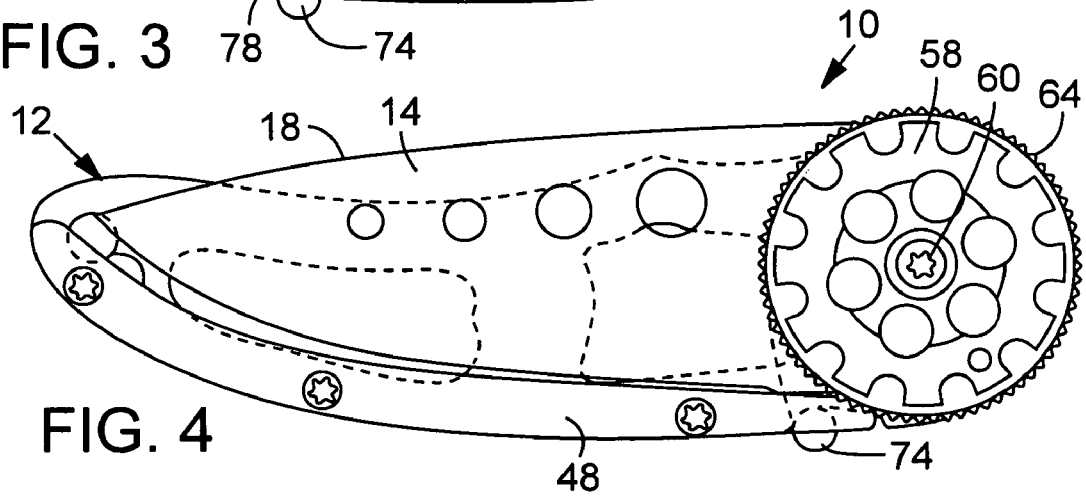
FIG. 4 is an elevation view of the opposite side of the knife of FIG. 1.
Figure 5:
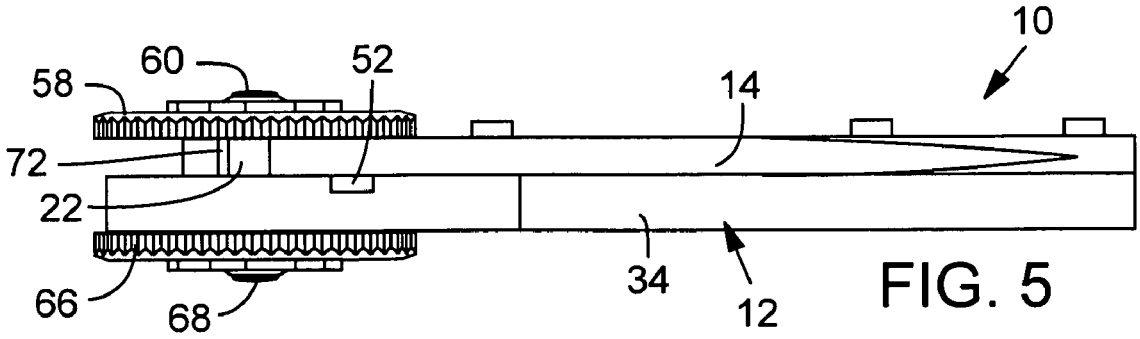
FIG. 5 is a top plan view of the knife of FIG. 1 showing the blade in the closed position.
Figure 6:
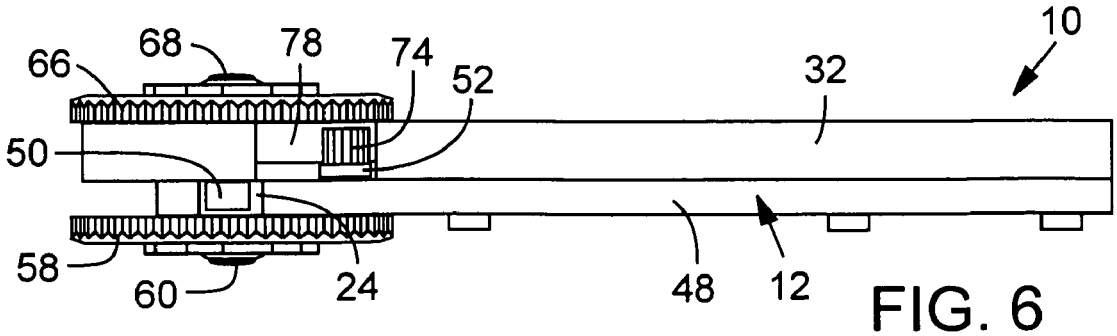
FIG. 6 is a bottom plan view of the knife of FIG. 1 showing the blade in the closed position.

The knife 10 desirably includes a locking lever 52 configured to prevent inadvertent displacement of the blade 14 when it is in the open and/or closed positions. The illustrated locking lever 52 is disposed in a recessed portion 76 formed in the distal end portion 28 of the handle portion 12 and is pivotally coupled to the distal end portion 28 by a pivot pin 54 (as best shown in FIGS. 7-9). As best shown in FIGS. 1 and 2, an exposed upper end portion 74 of the locking lever 52 resides in an elongated recessed portion 78 formed in the upper surface 32 of the handle portion 12. The upper end portion 74 can have a knurled outer surface as shown to provide a gripping surface.

The locking lever 52 can be manually pivoted toward and away from the base 40 about the pin 54 by moving the upper end portion 74. The locking lever 52 can be pivoted between a first, locked position (shown in solid lines in FIG. 8) and a second, unlocked position (shown in dashed lines in FIG. 8). The locking lever 52 includes an extension 56 positioned to engage the lower surface 44 of the base 40 when the locking lever 52 is in the locked position. Engagement of the extension 56 with the lower surface 44 prevents displacement of the base 40 within the slot 36, thereby preventing displacement of the blade 14.

To assist in opening and closing the blade 14, a first disc member, or wheel, 58 can be mounted to the tang portion 16 of the blade. As best shown in FIG. 7, the disc member 58 can be mounted by a screw 60 extending through a central opening in the disc member and a washer 62, and tightened into a threaded opening 84 in the pivot pin 42. A screw 80 extends through a respective opening in the disc member 58 and is tightened into a threaded opening 82 in the blade 14. The disc member 58 can include a knurled, outer peripheral surface 64 that serves as a gripping surface for manually rotating the disc member. Rotation of the disc member 58 about the screw 60 is effective to cause pivoting movement of the blade 14 about the pivot pin 42. If desired, a second disc member, or wheel, 66 can be mounted to the knife opposite the first disc member 58. As shown, the second disc member 66 can be mounted by a screw 68 extending through a central opening in the disc member and a washer 70, and tightened into a threaded opening (not shown) in the base 40 of the pivot pin 42.

Referring to FIGS. 8 and 9, the operation of the knife 10 will now be described. FIG. 8 shows the blade 14 in its fully extended, open and locked position. In this position, the spring 38 urges the base 40, and therefore the blade 14, toward the upper surface 32 of the handle portion 12 (in the direction of arrow A) so as to cause the locking pin 50 to engage the locking slot 22 of the blade. As noted above, engagement of the locking pin 50 with the locking slot 22 retains the blade against pivoting movement relative to the handle portion. In addition, the extension 56 of the locking lever 52 engages the lower surface 44 of the base 40 to prevent inadvertent displacement of the blade 14 relative to the handle portion. Thus, in this position, the blade 10 is securely fixed against any movement relative to the handle portion 12.

The blade 14 can be released for pivotal movement with respect to the handle portion 12 by first moving the locking lever 52 to its unlocked position (shown in dashed lines in FIG. 8) so that the extension 56 clears the lower surface 44 of the base. Manual pressure is then applied to the disc members 58, 66 in the direction of arrow B. This can be accomplished by grasping the knife 10 in a normal manner and pressing downwardly on the disc members 58, 66 with the thumb. The manual pressure shifts the blade 14 in the direction of arrow B and away from the locking pin 50. When the locking pin 50 clears the locking slot 22, as shown in FIG. 9, the blade 14 is free to pivot toward the closed position, in the direction indicated by arrow C.

Notably, the blade 14 can be unlocked and folded to its closed position using only one hand. For example, holding the knife in a normal manner, the locking lever 52 is moved to its unlocked position (FIG. 9) with the thumb. While pressing on the disc member 58 in the direction of arrow B with the thumb to release the blade from the locking pin 50, pressure is simultaneously applied to the disc member 58 in the general direction of arrow D (FIG. 9) with the thumb to cause rotation of the disc member 58 and corresponding pivoting movement of the blade 14. As the blade is pivoted to the closed position, pressure on the disc member 58 in the direction of arrow B can be released once the inner edge 72 of the locking slot 22 is rotated past the locking pin 50. The disc member 58 can be rotated with the thumb until the blade is in the closed position.

The closed (folded) position of the knife 10 is shown in FIG. 10. In this position, the blade 14 has been pivoted until the locking pin 50 engages the detent 24 in the tang portion 16. The folded knife blade 14 desirably does not contact the blade guard 48 to protect the sharpened edge 18 from damage. The bias of the compression spring 38 resiliently urges the blade 14 against the locking pin 40. The biasing force of the spring 38 desirably is sufficient to prevent the blade 14 from swinging open under its own weight. Using only one hand, the knife blade 14 can be returned to the open position by simply applying pressure to the disc member 58 in the general direction of arrow E (FIG. 10) with the thumb to cause rotation of the disc member and corresponding pivoting movement of the blade. Consequently, this method of opening the knife does not require the user to turn over and fling the wrist and/or forearm downwardly, as is typically done when opening a conventional folding knife with only one hand.

As can be appreciated, the knife 10 is especially useful to persons who experience difficulty in using two hands to open or close a folding knife because of a physical impairment or other reasons. Of course, if desired, the knife 10 can be opened and/or closed in a two-handed operation by simply grasping the handle portion 12 with one hand and using the other hand to pivot the blade 14 to the open or closed position.

In an alternative embodiment, the detent 24 can have a shape similar to that of the locking slot 22 so that the blade 14 is retained against pivoting movement by the locking pin 50 when the blade is in the closed position. In this alternative embodiment, the blade 14 can be opened by applying sufficient pressure to the disc member 58 in the direction of arrow B (FIGS. 8 and 9) to release the blade from the locking pin 50 and then applying a rotating force to the disc member to cause pivoting movement of the blade.

Figure 11:
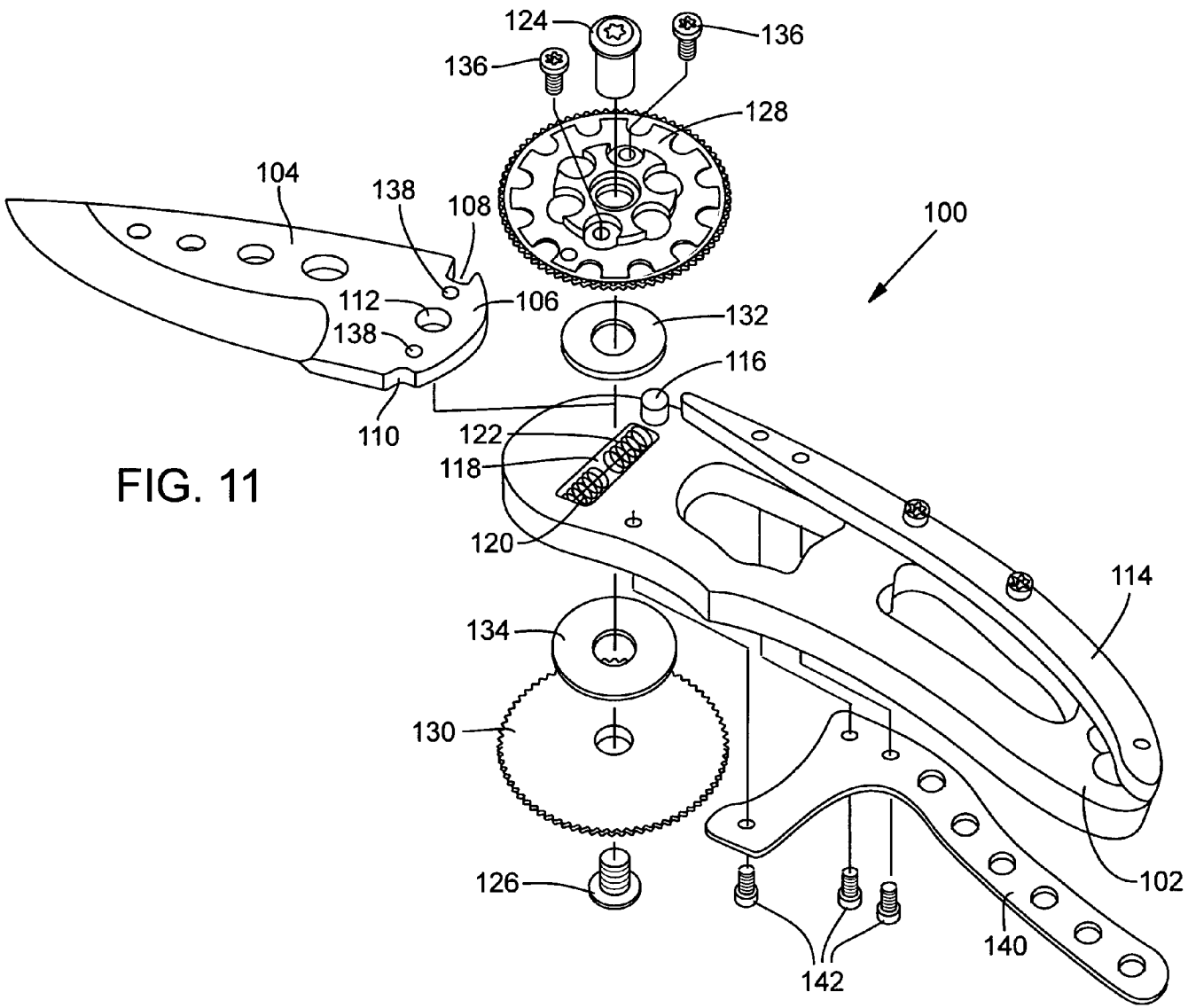
FIG. 11 is a perspective, exploded view of a folding knife, according to another embodiment.

FIG. 11 shows a folding knife 100, according to another embodiment. The folding knife 100 includes a handle portion 102 and a blade 104 pivotally coupled to the handle portion 102. The tang portion 106 of the blade 104 includes a locking slot 108, a detent 110, and a pivot opening 112. The handle portion 102 includes a blade guard 114, a locking pin 116, and a slot 118 elongated in a direction extending between the upper and lower surfaces of the handle portion. Disposed in the slot 118 are first and second coil springs 120, 122, respectively.

A pivot pin assembly comprising a pin 124 and a screw 126 extend through the opening 112 in the tang portion 106 and the slot 118 in the handle portion 102 for pivotally supporting the blade 104 relative to the handle portion. As shown, the pin 124 extends through a central opening in a disc member 128, a washer 132, and the slot 118. The screw 126 extends through a central opening in a disc member 130 and a washer 134, and is tightened into a threaded opening (not shown) in the pin 124. The springs 120, 122 bear against opposing sides of the pin 124. The disc member 128 can be secured to the blade 104 by screws 136 extending through respective openings in the disc member and tightened into respective threaded openings 138 in the tang portion 106. The pivot pin assembly is moveable relative to the slot 118 to permit displacement of the blade 104 in a first direction toward the upper surface of the handle portion 102 (as indicated by arrow A in FIG. 12) and in a second, opposing direction toward the lower surface of the handle portion 102 (as indicated by arrow B in FIG. 12).

The knife 100 also can include an optional money clip 140 (FIG. 11) secured to the handle portion 102 by screws 142.

Figure 12:
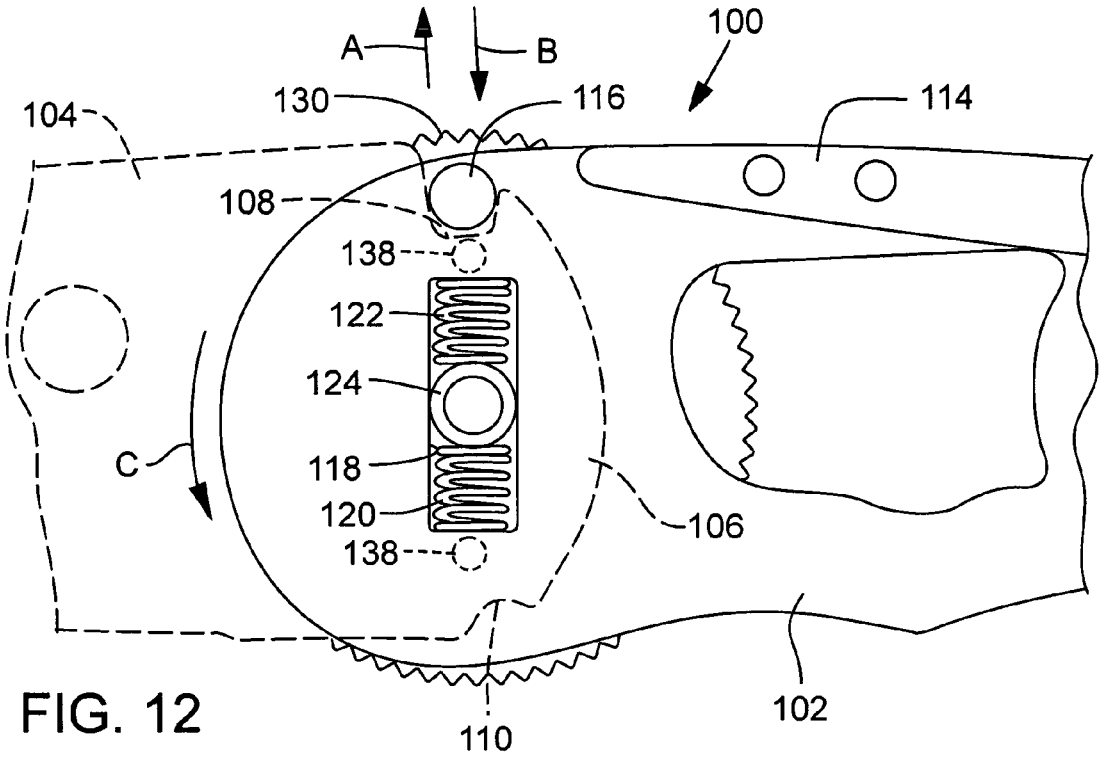
FIG. 12 is an enlarged, partial side elevation view of the knife of FIG. 11, showing a locking pin engaging a locking slot in the tang portion of the blade to prevent pivoting of the blade.
Figure 13:
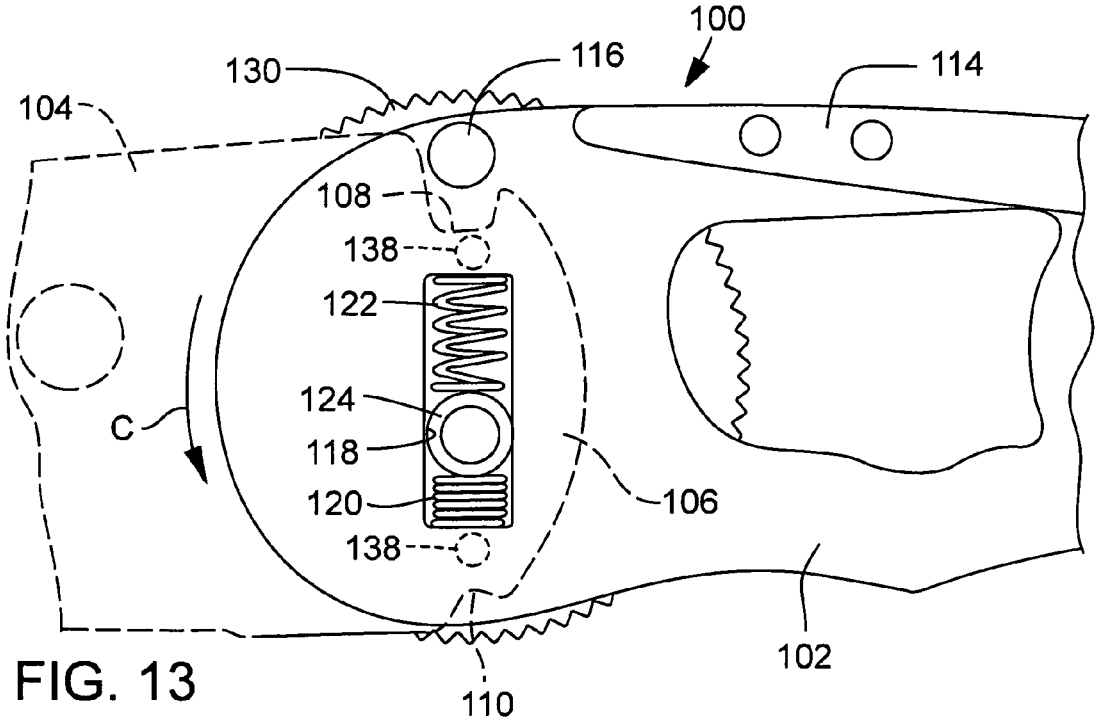
FIG. 13 is an enlarged, partial side elevation view similar to FIG. 12, but showing the blade released from the locking pin.
Figure 14:
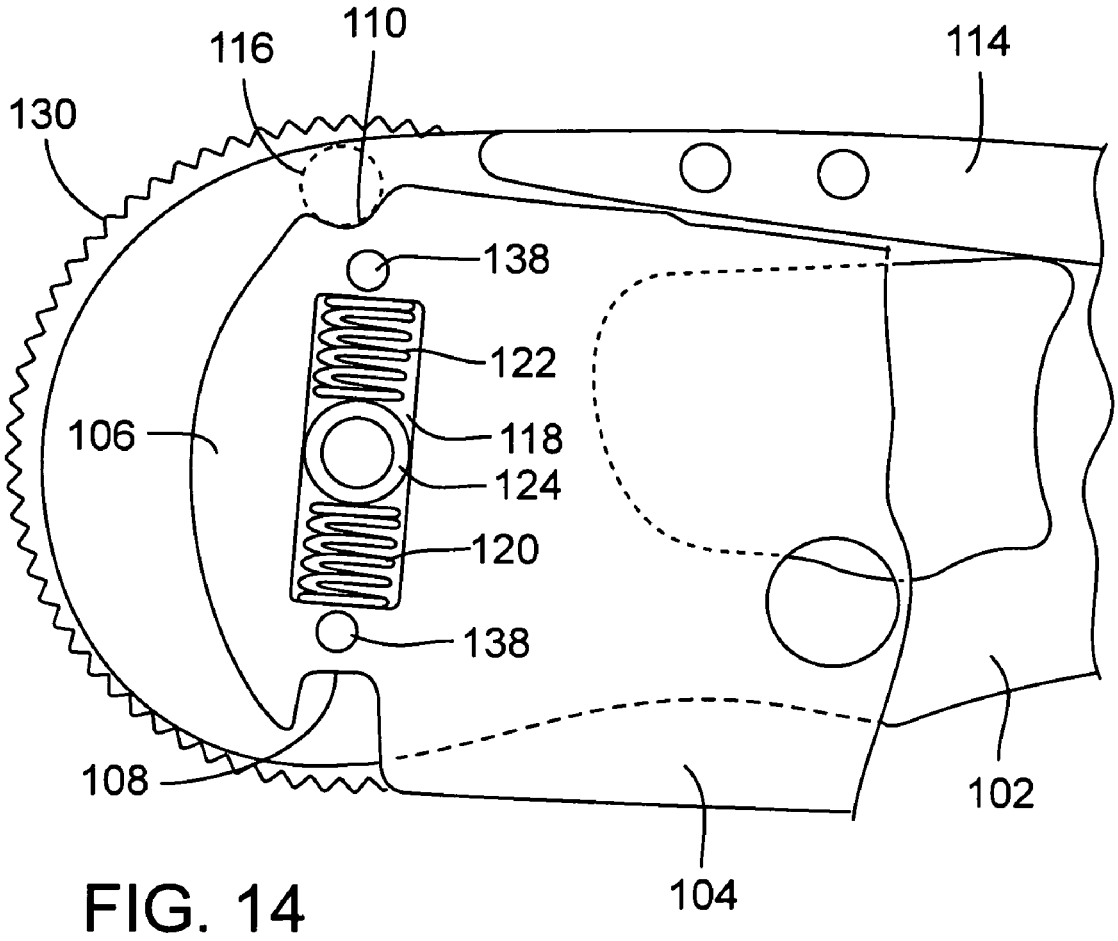
FIG. 14 is an enlarged, partial side elevation view similar to FIG. 12, but showing the blade in the closed position.

The knife 100 operates in a manner similar to the knife 10 of FIGS. 1-10. For example, FIG. 12 shows the blade 104 in the fully extended, open and locked position. In this position, the bias of the springs 120, 122 retain the blade 104 in a locked position with the locking pin 116 engaging the locking slot 108 of the blade. To release the blade 104 from the locking pin 116, pressure is applied to the disc members 128, 130 in the direction of arrow B to displace the blade 104 toward the lower surface of the handle portion 102, as shown in FIG. 13. When the locking pin 116 clears the locking slot 108, the blade 104 is free to pivot toward the closed position, as indicated by arrow C. When the blade is in the closed position, as shown in FIG. 14, the bias of the springs 120, 122 resiliently urge the blade 104 to engage the locking pin 116 at the detent 110.

Figure 15:
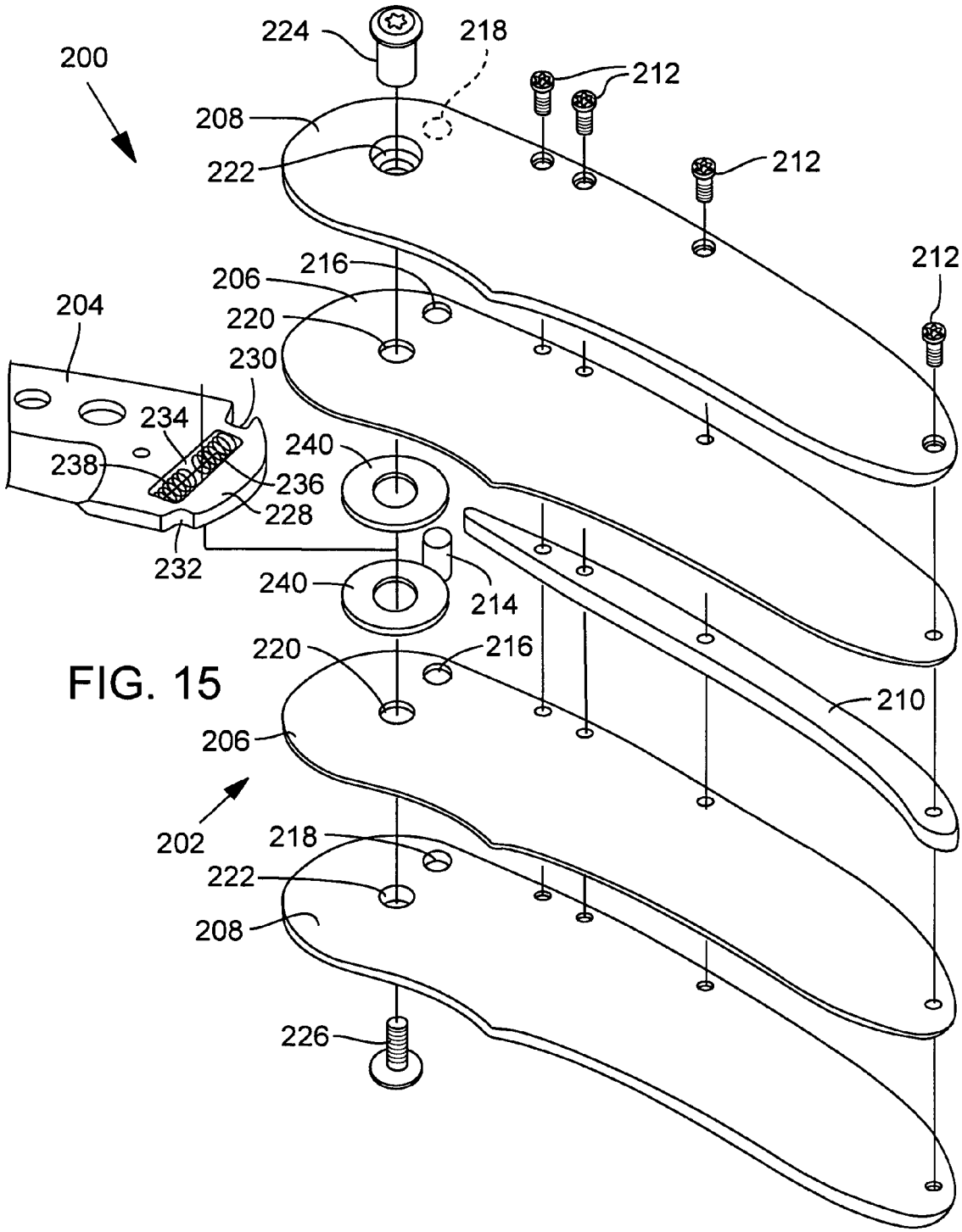
FIG. 15 is a perspective, exploded view of a folding knife, according to another embodiment.

FIG. 15 shows a folding knife 200 according to another embodiment. The knife 200 includes a handle portion 202 and a blade 204 pivotally coupled to the handle portion 202. The handle portion 202 in the illustrated embodiment includes transversely spaced liner plates 206 and side panels 208 mounted to the outside of the liner plates 206. The side panels 208 can be made from bone, metal, wood, or other natural or synthetic materials for decorative purposes. The liner plates 206 and the side panels 208 are spaced by a blade guard 210 that desirably extends almost the full length of the handle portion. The guard 210 defines a blade slot between the liner plates 206 that receives the blade 204 when it is folded to the closed position. As shown, the liner plates 206, the side panels 208, and the guard 210 can be secured to each other with screws 212 extending transversely through the handle portion. In alternative embodiments, the liner plates 206 can be spaced from each other by a series of smaller spacer elements interposed between the liner plates and spaced from each other along the length of the handle portion.

The handle portion 202 can also include a transversely extending locking pin 214. The locking pin 214 in the illustrated configuration is supported in respective openings 216 in the liner plates 206 and openings 218 in the side panels 208. The handle portion 202 is also formed with respective openings 220 in the liner plates 206 and openings 222 in the side panels 208 for receiving a pivot pin assembly comprising a pivot pin 224 and a screw 226.

The tang portion 228 of the blade 204 is formed with a locking slot 230, a detent 232, and an elongated slot 234. Disposed in the slot are first and second coil springs 236, 238, respectively. When assembled, the tang portion 228 is disposed between the distal end portions of the liner plates 206. Washers 240 can be positioned on opposing sides of the tang portion 228. The pivot pin 224 extends through openings 222 in the side panels 208, the openings 220 in the liner plates 206, the washers 240, and the elongated slot 234 between the springs 236, 238. The screw 226 is tightened into a threaded opening (not shown) in the pivot pin 224. The blade 204 can be displaced relative to the pivot pin 224 and the handle portion 202 in a first direction toward the upper surface of the handle portion 202 (as indicated by arrow A in FIG. 16) and in a second, opposing direction toward the lower surface of the handle portion (as indicated by arrow B in FIG. 16). The springs 236, 238 bear against opposing sides of the pivot pin 224 to provide a biasing force against displacement of the blade 204.

Figure 16:
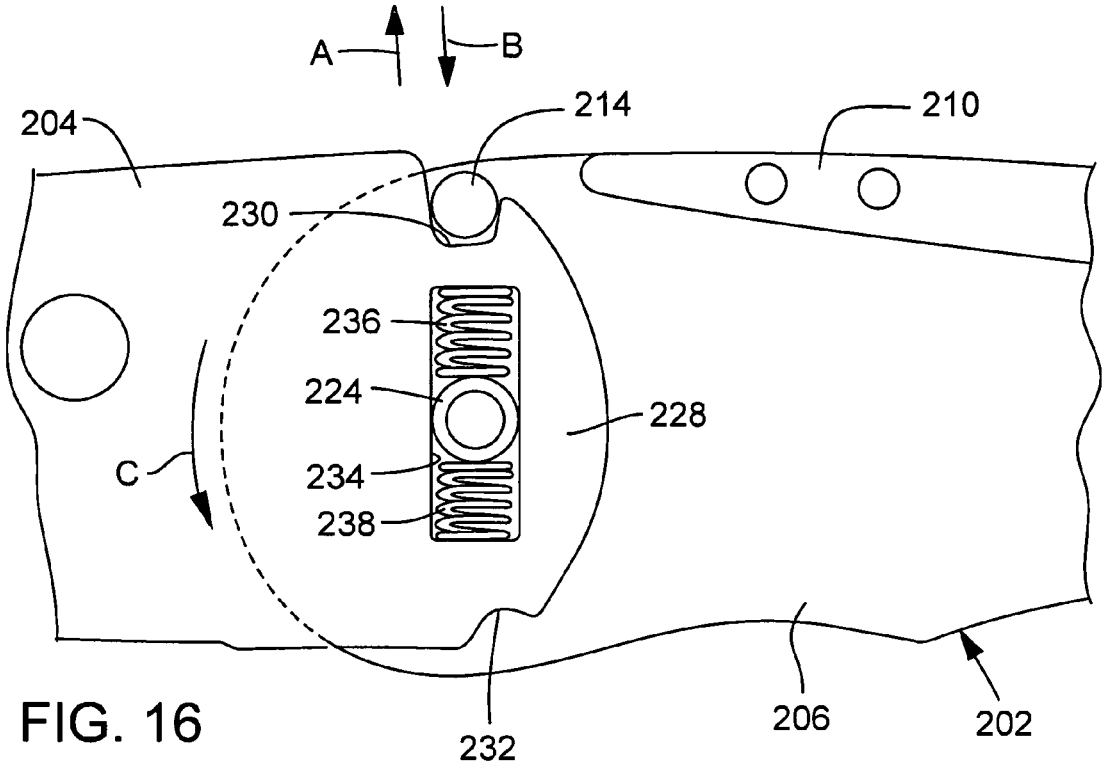
FIG. 16 is an enlarged, partial side elevation view of the knife of FIG. 15, showing a locking pin engaging a locking slot in the tang portion of the blade to prevent pivoting of the blade.
Figure 17:
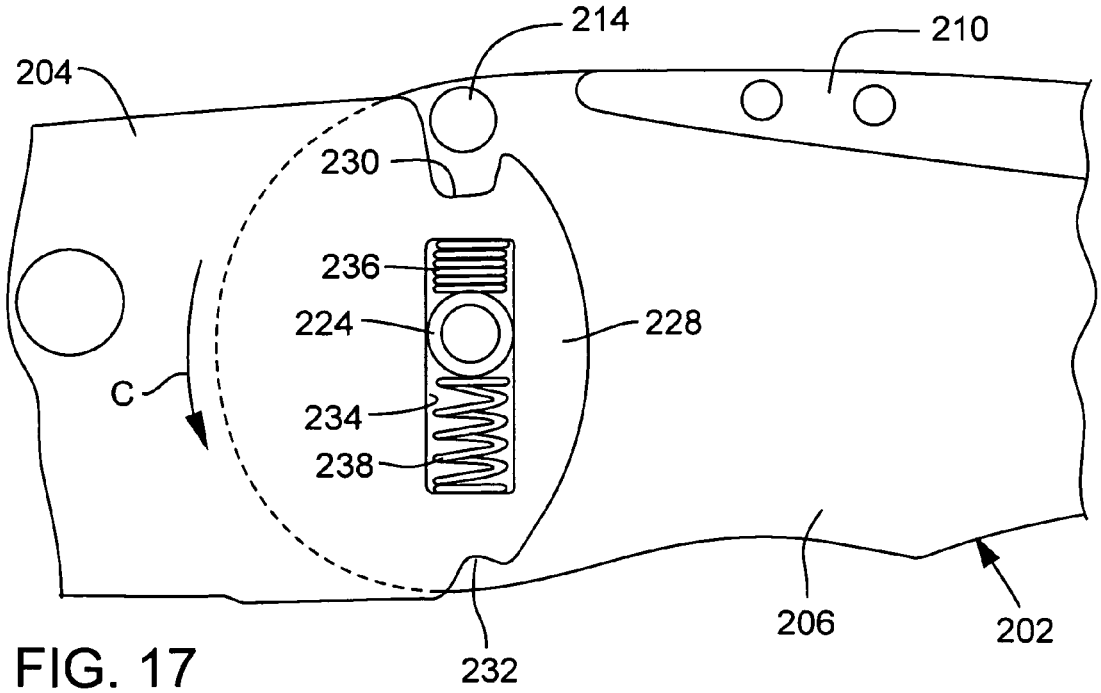
FIG. 17 is an enlarged, partial side elevation view similar to FIG. 16, but showing the blade released from the locking pin.

The knife 200 operates in a manner similar to the knife 10 of FIGS. 1-10 and the knife 100 of FIGS. 11-14, except that in the knife 200, the pivot pin 224 is fixed with respect to the handle portion 202 and the blade 204 can be displaced relative to the pivot pin to unlatch the blade from the locking pin. For example, FIG. 16 shows the blade 204 in the fully extended, open and locked position. In this position, the bias of the springs 236, 238 retain the blade 204 in a locked position with the locking pin 214 engaging the locking slot 230 of the blade. To release the blade 204 from the locking pin 214, pressure is applied to the blade in the direction of arrow B to shift the blade toward the lower surface of the handle portion 202, as shown in FIG. 17. When the locking pin 214 clears the locking slot 230, the blade 104 is free to pivot toward the closed position, as indicated by arrow C. When the blade is in the closed position, the bias of the springs 236, 238 resiliently urge the blade 204 to engage the locking pin 214 at the detent 232.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

We claim:

1. A folding knife comprising:

a handle portion having a top longitudinal edge and a bottom longitudinal edge; and a blade pivotally connected to the handle portion for pivoting movement of the blade between an open position and a closed position, the blade having an upper longitudinal edge and a lower longitudinal edge defining a plane within which the blade pivots, wherein the blade can be displaced independent of pivoting movement of the blade and relative to the handle portion in the plane in a first direction extending from the top longitudinal edge to the bottom longitudinal edge of the handle portion while the blade is connected to the handle portion;

a biasing member coupled to the blade and configured to bias the blade in a second direction opposite the first direction; and a pivot pin extending through an aperture in the blade and a slot in the handle portion, the pivot pin being displaceable with the blade in the first direction, the biasing member being disposed in the slot and configured to exert a biasing force against the pivot pin in the second direction.

2. The folding knife of claim 1, further comprising a locking member configured to engage and lock the blade in the open position, and wherein the blade is displaceable in the first direction against the biasing member to unlock the blade from the locking member and permit pivoting of the blade to the closed position.

3. The folding knife of claim 2, wherein:

the locking member comprises a locking pin extending transversely from the handle portion;

the blade comprises a tang portion and a locking slot formed in the tang portion; and wherein when the blade is in the open position, the biasing member resiliently biases the blade in the second direction to cause the locking pin to engage the locking slot.

4. A folding knife comprising:

a handle portion having a top edge and a bottom edge;

a blade pivotally connected to the handle portion for pivoting movement of the blade between an open position and a closed position, the blade defining a plane within which the blade pivots, wherein the blade can be displaced independent of pivoting movement of the blade and relative to the handle portion in the plane in a first direction extending from the top edge to the bottom edge of the handle portion while the blade is connected to the handle portion;

a biasing member coupled to the blade and configured to bias the blade in a second direction opposite the first direction; and a locking member configured to engage and lock the blade in the open position, and wherein the blade is displaceable in the first direction against the biasing member to unlock the blade from the locking member and permit pivoting of the blade to the closed position;

wherein the locking member comprises a locking pin extending transversely from the handle portion, the blade comprises a tang portion and a locking slot formed in the tang portion, and wherein when the blade is in the open position, the biasing member resiliently biases the blade in the second direction to cause the locking pin to engage the locking slot;

wherein:

the tang portion comprises a detent; and wherein when the blade is in the closed position, the biasing member resiliently biases the blade in the second direction to cause the locking pin to engage the detent.

5. The folding knife of claim 1, further comprising a locking lever pivotally coupled to the handle portion for pivoting movement between a locked position and an unlocked position, wherein when the locking lever is in the locked position, the locking lever prevents displacement of the pivot pin and the blade in the first direction and wherein when the locking lever is in the unlocked position, the pivot pin and the blade can be displaced in the first direction.

6. The folding knife of claim 5, wherein the locking lever is configured to engage the pivot pin in the locked position to prevent displacement of the pivot pin and the blade in the first direction.

7. The folding knife of claim 6, wherein:

the biasing member is a coil spring that is oriented to be compressed between a surface of the slot and an opposing surface of the pivot pin; and the locking lever engages the opposing surface of the pivot pin when the locking lever is in the locked position.

8. The folding knife of claim 1, further comprising at least one disc member coupled to a tang portion of the blade and being manually rotatable by a user to pivot the blade between the open and closed positions.

9. The folding knife of claim 8, wherein the disc member has a knurled, circumferentially extending outer surface.

10. The folding knife of claim 1, wherein the biasing member is a coil spring.

11. A folding knife comprising:

a handle portion defining a slot;

a blade pivotally coupled to the handle portion for pivoting movement of the blade between an open position and a closed position, the blade defining a plane within which the blade pivots; and a pivot pin disposed in the slot and defining a pivot axis for the blade, the pin pivotally supporting the blade so as to allow pivoting of the blade about the pivot axis, the pivot pin being displaceable in the slot along an imaginary straight line from a first position to a second position, spaced from the first position, to allow displacement of the blade relative to the handle portion in a first direction in the plane when manual pressure is applied to the blade, wherein displacing the pin from the first position to the second position also displaces the pivot axis along the imaginary line; and at least one biasing member disposed in the slot and configured to exert a biasing force against the pivot pin and the blade in a second direction, opposite the first direction, wherein the biasing force is effective to move the pin from the second position back to the first position in the second direction and along the imaginary line when manual pressure is removed from the blade;

wherein the at least one biasing member is a coil spring.

12. The folding knife of claim 11, wherein the at least one biasing member comprises first and second coil springs positioned on diametrically opposing sides of the pivot pin.

13. A folding knife comprising:

a handle portion defining a slot, the slot extending along an axis that is non-parallel to a longitudinal axis of the handle portion;

a blade pivotally coupled to the handle portion for pivoting movement of the blade between an open position and a closed position, the blade defining a plane within which the blade pivots; and a pivot pin disposed in the slot and defining a pivot axis for the blade, the pin pivotally supporting the blade so as to allow pivoting of the blade about the pivot axis, the pivot pin being displaceable in the slot along an imaginary line from a first position to a second position, spaced from the first position, to allow displacement of the blade relative to the handle portion in a first direction in the plane, wherein displacing the pin from the first position to the second position also displaces the pivot axis along the imaginary line; and at least one biasing member disposed in the slot and configured to exert a biasing force against the pivot pin and the blade in a second direction, opposite the first direction;

further comprising a locking member configured to engage and lock the blade when the blade is pivoted to the open position, the blade being releasable from engagement with the locking member by displacement of the blade in the first direction against the biasing force of the biasing member.

14. The folding knife of claim 13, wherein the handle portion defines a longitudinal axis and the first direction is generally perpendicular to the longitudinal axis.

15. The folding knife of claim 11, further comprising a locking lever pivotally coupled to the handle portion and configured to pivot between a first position and a second position, wherein when the locking lever is in the first position, the locking lever extends into the slot and prevents displacement of the pin, and therefore the blade, in the first direction, and wherein when the locking lever is in the second position, the locking lever is removed from preventing displacement of the pin and the blade in the first direction.

16. The folding knife of claim 11, further comprising at least one wheel coupled to a tang portion of the blade and being manually rotatable by a user to cause pivoting of the blade relative to the handle portion.

17. A folding knife comprising:

a handle portion defining a longitudinal axis;

a blade pivotally connected to the handle portion for pivoting movement of the blade between an open position and a closed position, the blade having an upper longitudinal edge and a lower longitudinal edge defining a plane within which the blade pivots and being configured such that, when the blade is in the open position and the closed position, the blade can be displaced independent of pivoting movement of the blade and relative to the handle portion in the plane in a first direction that is generally perpendicular to the longitudinal axis while the blade is connected to the handle portion; and further comprising a locking pin configured to engage the blade and prevent pivoting movement of the blade when the blade is in the open position, and wherein displacement of the blade in the first direction is effective to disengage the blade from the locking pin and permit pivoting movement of the blade.

18. The folding knife of claim 17, further comprising a biasing member operatively coupled to the blade and the handle portion so as to resiliently move the blade into engagement with the locking pin when the blade is in the open position.

19. A folding knife comprising:

a handle portion having a top edge and a bottom edge and defining a longitudinal axis, the handle portion having a slot;

a blade having a tang portion pivotally coupled to the handle portion for pivoting movement of the blade between an open position and a closed position, the blade defining a plane within which the blade pivots, the tang portion having a locking slot on an upper edge thereof, a detent on a lower edge thereof, and an opening;

a pivot pin disposed in the slot in the handle portion and extending into the opening in the tang portion for pivotally supporting the blade relative to the handle portion;

a locking pin extending transversely from the handle portion, the locking pin being configured to engage the locking slot and prevent pivoting movement of the blade when the blade is in the open position, the locking pin being configured to engage the detent when the blade is in the closed position;

at least one compression spring disposed in the slot in the handle portion and oriented such that it can be compressed between a surface of the slot and a surface of the pivot pin, the spring configured to yieldably urge the pivot pin, and therefore the blade, in a first direction in the plane of the blade to cause the locking pin to engage the locking slot when the blade is in the open position;

wherein the blade is displaceable in a second direction opposite the first direction in the plane against the spring to release the blade from the locking pin and permit pivoting of the blade to the closed position;

a locking lever pivotally coupled to the handle portion for pivoting movement between a locked position and an unlocked position, wherein when the locking lever is in the locked position and the blade is in the open position, the locking lever engages the pivot pin to prevent displacement of the pivot pin and the blade in the second direction and wherein when the locking lever is in the unlocked position, the pivot pin and the blade can be displaced in the second direction; and at least one disc member coupled to the tang portion of the blade and being manually rotatable by a user to pivot the blade between the open and closed positions.

* * * * *